US006523936B2

(12) United States Patent
Zapata et al.

(10) Patent No.: US 6,523,936 B2
(45) Date of Patent: Feb. 25, 2003

(54) BANDING REDUCTION IN INCREMENTAL PRINTING, BY SPACING-APART OF SWATH EDGES AND RANDOMLY SELECTED PRINT-MEDIUM ADVANCE

(75) Inventors: Elizabeth Zapata, Barcelona (ES); Salvador Sanchez, Sant Cugat del Valles (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/012,281

(22) Filed: Nov. 2, 2001

(65) Prior Publication Data

US 2002/0041306 A1 Apr. 11, 2002

Related U.S. Application Data

(62) Division of application No. 09/516,816, filed on Mar. 1, 2000, now Pat. No. 6,336,702.

(51) Int. Cl.[7] ..... B41J 2/145; B41J 2/15

(52) U.S. Cl. ..... 347/41

(58) Field of Search ..... 347/16, 41

(56) References Cited

U.S. PATENT DOCUMENTS 6,086,181 A * 7/2000 Majette et al. ..... 347/16

6,336,702 B1 * 1/2002 Zapata et al. ..... 347/41

* cited by examiner

*Primary Examiner*—Thinh Nguyen
(74) *Attorney, Agent, or Firm*—Ashen & Lippman

(57) ABSTRACT

A printhead makes passes over a printing medium, each pass forming a swath of marks on the medium. In one aspect of the invention, between passes the medium steps by a non-zero distance that varies from step to step. In another aspect, swath edges are spaced away (ideally well away) from each other. In yet another aspect a printer has a reciprocating carriage—to carry a printhead for forming, in each certain multiple of a half-reciprocation, a swath of marks on the medium. Each head includes multiple printing elements, a number of combinations of groups of which are used to print each region of each swath; the invention increases the number of combinations used to print each region. In still another aspect, the step distance is random or randomized. Ideally these aspects are all used together. Preferably (1) step distance varies at every step—e.g. alternating between two values, such as a sixth and a half of swath height, for three-passes; (2) the number N of passes is odd, and the distance varies among values of form (2n−1)/2N, n ranging from 1 through N; (3) banding with the method has twice the spatial frequency of banding with nonvarying step distance; (4) no two swath edges coincide, and the distance is random or randomized; (5) an installed algorithm for accommodating print-medium-advance-directionality error is adapted for step control; and (6) the certain multiple is one half or one full reciprocation, or two full reciprocations.

11 Claims, 7 Drawing Sheets

| | UNIFORM ADVANCE | | | NON-UNIFORM ADVANCE | | |
|---|---|---|---|---|---|---|
| PASS NUMBER | ADVANCE | START NOZZLE | NOZZLE PAIRED WITH #201 | ADVANCE | START NOZZLE | NOZZLE PAIRED WITH #201 |
| 1 | 150 | 1 | 51 | 150 | 1 | 51 |
| 2 | 150 | 1 | 51 | 144 | 7 | 57 |
| 3 | 150 | 1 | 51 | 149 | 2 | 52 |
| 4 | 150 | 1 | 51 | 143 | 8 | 58 |
| 5 | 150 | 1 | 51 | 148 | 3 | 53 |
| 6 | 150 | 1 | 51 | 141 | 10 | 60 |
| 7 | 150 | 1 | 51 | 147 | 4 | 54 |
| 8 | 150 | 1 | 51 | 145 | 6 | 56 |
| 9 | 150 | 1 | 51 | 142 | 9 | 59 |
| 10 | 150 | 1 | 51 | 146 | 5 | 55 |
| TOTAL ADVANCE | 1500 | | | 1455 | | |
| THRUPUT LOSS | 0% | | | 3% | | |

BANDING REDUCTION IN INCREMENTAL PRINTING, BY SPACING-APART OF SWATH EDGES AND RANDOMLY SELECTED PRINT-MEDIUM ADVANCE

CROSS REFERENCE TO RELATED APPLICATION(S)

This is a divisional of application Ser. No. 09/516,816 filed on Mar. 1, 2000, now U.S. Pat. No. 6,336,702 which is hereby incorporated by reference herein.

RELATED PATENT DOCUMENTS

A closely related document is another, coowned U.S. utility-patent application filed in the United States Patent and Trademark Office substantially contemporaneously with this document. It is in the name of Askeland, identified as Hewlett Packard Company docket number PD-10982166-1 and entitled "BANDING REDUCTION IN INCREMENTAL PRINTING, THROUGH VARIATION OF NOZZLE COMBINATIONS AND PRINTING-MEDIUM ADVANCE"—subsequently assigned utility-patent-application Ser. No. 09/1516.815. That document, and other related documents cited or discussed in it, are hereby incorporated by reference in their entirety into this document.

Other related documents also wholly incorporated by reference herein are other, coowned U.S. utility-patent applications filed in the United States Patent and Trademark Office generally contemporaneously with this document. One such document, pertinent for its introduction of print-medium-axis directionality ("PAD") error, is in the name of Doval and identified as Hewlett Packard Company docket number PD-60980081H95, under the title "COMPENSATION FOR MARKING-POSITION ERRORS ALONG THE PEN-LENGTH DIRECTION, IN INKJET PRINTING". It was later assigned utility-patent-application Ser. No. 09/693,524. Another such document of Doval, U.S. patent-application Ser. No. 09/408,407, issued as U.S. Pat. No. 6,408,407, shows that extremely tiny (i. e. a pixel row or less) imprecisions or variation in print-medium advance can be helpful, whereas repetitive somewhat larger advance errors are more often troublesome.

Other such documents, pertinent for their introduction of printing-element selection generally (and swath-height manipulation to accommodate such selection), are in the name of Askeland. They are identified as Hewlett Packard docket numbers PD-10982150Z111, entitled "ADAPTIVE INCREMENTAL-PRINTING MODE THAT MAXIMIZES THROUGHPUT WHILE MAINTAINING INTERPEN ALIGNMENT BY NOZZLE SELECTION", and PD-10982151Z112, entitled "ADAPTIVE INCREMENTAL-PRINTING MODE THAT MAXIMIZES THROUGHPUT BY SHIFTING DATA TO PRINT WITH PHYSICALLY UNALIGNED NOZZLES"—and subsequently assigned respective patent-application Ser. Nos. 09/492,564 and 09/492,929.

Still another such document is in the name of Gil, and is pertinent for its introduction of printmode techniques that enable printers to develop printmasks in the field, from factory-supplied kernels or algorithms, very efficiently and quickly. This document is identified as Hewlett Packard Company docket PD-60990032Z21, intended for filing shortly after the present document—and subsequently assigned utility-patent-application Ser. No. 09/ 516,323, and issued as U.S. Pat. No. 6,312,098.

FIELD OF THE INVENTION

This invention relates generally to machines and procedures for printing text or graphics on printing media such as paper, transparency stock, or other glossy media; and more particularly to a scanning thermal-inkjet machine and method that construct text or images from individual nal pixel array. The invention employs print-mode techniques to optimize image quality.

BACKGROUND OF THE INVENTION (a) Spatial-frequency effects in banding—A persistent problem in incremental printing is conspicuously visible banding or patterning, which arises from a great variety of causes. Generally these causes are associated with repetitive phenomena that are inherent in the swath-based natured of such printing.

Joan Manel Garcia, in U.S. utility-patent applications Ser. No. 09/150,321 through '323, particularly addresses problems of patterning in the lateral or transverse dimension, i. e. parallel to the scan axis. He points out that such patterning is especially objectionable when it occurs at spatial periodicities to which the human eye is particularly sensitive.

Garcia shows that such banding can be rendered very inconspicuous at normal reading distances by moving its periodicity to roughly 3 cm (1 inch), or preferably a bit longer. This can be accomplished by tiling printmasks of those widths.

Unfortunately that technique is not now readily applicable to the longitudinal dimension—i. e. to the direction parallel to the print-medium advance axis. The reason is that, generally, largest current-day printheads are only about 2½ cm (1 inch) long in that direction.

Within the corresponding available range of spatial frequencies, banding in the lower three-quarters of that range (used in single-pass through four-pass printmodes) is quite conspicuous. Unfortunately the current trend toward reducing the number of passes used for printing each image segment—to enhance overall printing throughput—militates toward use of precisely that part of the range.

(b) Swath-interface effects—Some banding along the print-medium advance axis arises at the interfaces between swaths—due to the advance errors and "PAD" errors mentioned above, and due to ink-media interactions such as coalescence or print-medium expansion. Earlier documents such as Doval's have pointed out that repetitive, small failures of abutment themselves introduce banding (though extremely tiny imprecisions or variations in abutment can be helpful).

Swath-abutment irregularities may represent the single most conspicuous form or type of banding effect. When one swath edge is closely abutted to another, the abutment is almost always imperfect—leading to either a shallow gap between swaths or a shallow overprint where they overlap.

Also the two swaths are generally not exactly the same in darkness or color saturation, adding another element of contrast along the interface. Such problems are aggravated by a high or abrupt gradient of wetness along the edge of a just-deposited swath, when an abutting swath is formed soon after.

(c) Internal effects—Not all banding problems, however, occur at swath boundaries. Some result simply from nozzle PAD problems and these can be entirely internal to the swath.

Internal patterns can be formed by repetitive coincidences of nozzle irregularities. Prior systematic procedures placed particular irregularly-performing pairs (or other groups) of printhead elements into conjunction—with respect to the printing medium—over and over.

As an example, the Hewlett Packard Company printer product known as the Model 2000C uses two-pass bidirectional printmodes—each pixel row being printed by two separate nozzles. At 24 rows per millimeter (600 dots per inch, dpi), a 12.7 mm (half inch) pen, has 300 nozzles.

Ordinarily nozzles number 1 and 151 contribute drops to the same image row—using a 6⅓ mm (quarter inch) advance and, again, a two-pass, 300-nozzle printmode. Every 6⅓ mm these same two nozzles are paired (see FIG. 7 and the Table).

If nozzles 1 and 151 when used in combination form a noticeable band effect, this effect is highly visible to the user—because it is present in a repeating pattern, roughly every 6 mm or quarter inch. For example, if both nozzles happen to be directed well away from their nominal target pixel row, then that pixel row will appear unprinted (at least in the particular color in which the head in question prints), rather than the nominal double-printed.

Another kind of band effect can be caused by an interaction of nozzles that are adjacent or nearby. For example assume that nozzle number 5 is aimed "low" (toward the nominal target row for nozzle 6). If nozzle 6 is aimed accurately, its target row will be double-printed.

If in addition nozzle 156 is also aimed accurately but nozzle 157 is aimed "high" (i. e. both toward the target row for nozzle 156), then in the printed image the common pixel row for nozzles 6 and 156 will be quadruple-printed—while the adjacent rows above and below will each be single-printed rather than the nominal (double printed).

In short, banding within swaths results from repetitive coincidences between irregularly printing elements within each combination. Patterning arises from repetitive, systematic operation.

Objectionable patterning is subject to quantitative effects. Thus some printmasking approaches to patterning in effect simply dilute repetition within an environment of a greater number of alternative states.

(d) Multipass printmode solutions—Heretofore a common strategy for dealing with all these problems has been to increase the number of passes used to print each image segment. This strategy, however, degrades printing throughput.

It is therefore disadvantageous in the present market, which is increasingly more demanding. This marketplace is characterized by continuously escalating consumer perceptions of what constitutes an acceptable overall image-printing time.

(e) PAD factor—Another kind of band effect arises, particularly with certain pens using tape automated bonding ("TAB") nozzle arrays, in image areas where adjacent swaths nominally abut. These effects occur because some modern pens are subject to a concentration of aiming errors at the ends of the pen—most classically out-board-aimed nozzles 91 (FIG. 8) as distinguished from the great majority of more centrally disposed nozzles 90.

This higher density of errors, with systematic out-board aim, results from the greater difficulty of maintaining TAB-tape nozzle arrays planar, in comparison with the metal nozzle plates used earlier. In some heads, particularly at the ends of the array, the tape is typically wrapped around the adjacent ends of the printhead—causing the tape to curl very slightly.

The out-board aim in pens of this type increases 93 the overall dimension of the pixel swath in the print-medium-advance axis, beyond the nominal width 92. Typically this overall increase has been on the order of two or three rows.

As a result, when adjacent swaths 94, 96 that should neatly abut are printed with a nominal advance of the print-medium-advance mechanism (FIG. 9, left-hand "A" view), those swaths will instead overlap slightly. This occurs because an error region 93 (FIG. 9, "A" view) in one of the swaths 94 projects into the region 92' which should be occupied by the other swath 96.

Meanwhile a like error region 93' extending from that other swath 96 projects into the region which should be occupied by the first swath 94. As the illustration suggests, these extensions are not limited to the exemplary composite printout 98 of only three swaths 94–96; rather, the phenomenon propagates as at 93" to still further swaths above and below.

When these swaths are thus printed with nominal advance of the print-medium-advance mechanism, these effects produce, within the composite printout 98, a dark band in each overlap area. The darker inking there is usually at the expense of slight lightening within a few pixel rows inboard from (i. e. above and below) the nominal swath edge. The overall consequence is formation of undesired striations within the composite printout 98.

To mitigate this type of artifact due to out-board PAD error, some printers provide built-in algorithmically operated automatic measurement of the effective increase of the pixel-swath dimension. This is followed by automatic adjustment of the printing-medium advance, typically extending the advance stroke by about half the extension of the swath dimension.

Hence the same swaths 94'–96' (right-hand "B" view, FIG. 9) are now stepped slightly further apart in the longitudinal direction, so that the same error regions 93, 93'—of the alternate swaths 94', 96' respectively—now either abut or overlap just slightly. The result is a lengthened composite printout 98' in which at least the conspicuousness of the striations is significantly suppressed.

The measurement is sometimes couched in terms of finding a so-called "PAD factor", the ratio of actual to nominal swath dimension—in early systems always a number just slightly larger than unity. This technique cures neither PAD nozzle errors nor swath-dimension expansions, but rather accommodates these defects to reduce conspicuousness of overlap.

More recently, with continuing efforts to control PAD error, such error is no longer always out-board and the swath-dimension change is no longer always an expansion but sometimes a contraction. Through the automatic accommodations just discussed, therefore, sometimes the PAD factor is just under unity rather than just over—and the print-medium advance stroke is shortened rather than lengthened.

Finally, in the most-current products PAD error is no longer systematically concentrated at the ends of the nozzle array but rather is somewhat randomly distributed along the array length. With these latest developments the PAD factor differs only insignificantly from unity and the automatic control algorithm, though factory installed and in some units actually operating in the field, usually serves little purpose.

To the extent that dot-placement error is localized randomly along the printhead, the algorithm does not produce the intended results. Furthermore the printout remain susceptible to the other banding problems introduced in the preceding subsections (a) through (d).

As there remains a very real possibility of future production-run variations reintroducing the desirability of automatic monitoring and stroke adjustment, this algorithmic monitoring and control of effective array length is probably best retained in printer products. It has not heretofore been suggested, however, that this built-in feature might have additional utility—previously unappreciated—for addressing the other types of banding phenomena discussed in subsections (a) through (d) above.

(f) Conclusion—Thus failure to effectively address problems of banding in printmodes using low numbers of passes has continued to impede achievement of uniformly excellent inkjet printing—at high throughput. Thus important aspects of the technology used in the field of the invention remain amenable to useful refinement.

SUMMARY OF THE DISCLOSURE

The present invention introduces such refinement. Before proceeding to a relatively rigorous introduction of the invention, this section first presents an informal orientation to some insights which may in a sense have been a part of the making of the invention.

To make banding effects less conspicuous, the spatial frequency or wavenumber of the banding can be raised (i. e. the period shortened, lowered). Banding at higher spatial frequency is less visible to the human eye than banding at a low frequency.

Garcia's previously mentioned technique works because the visual response characteristic Peaks—so that low frequencies, too, are less visible. For the ranges currently available with printheads 2½ cm long, and less, however, what is most effective is to resort to the higher frequencies.

Some patterns, as noted earlier, are formed by repetitive coincidences of nozzle irregularities. Such undesired coincidences can occur consistently only if common step distances are used repetitively.

Repetitive use of step distances has the effect of placing particular irregularly-performing pairs or other groups of printhead elements into conjunction with respect to the printing medium—again and again. The coincidences themselves are always present, at least in a latent or virtual sense, because the pairs or groups of irregularly performing elements are always present in the printhead—but they become visible and thereby objectionable only when developed on the printing medium by regular repetition of step distance.

As to the previously mentioned problems associated with abutting swaths, these can be mitigated very greatly by avoiding all formation of abutting swaths. Advantageously this is done with great care, because earlier work such as Doval's has pointed out that repetitive, small failures of abutment themselves introduce banding. Spacing swath edges away from one another, however—or preferably well away, and preferably in a time-varying fashion—very significantly reduces abutment-related banding constituents.

In general the innovations introduced in this document achieve valuable reduction in banding without resort to large numbers of passes. In this way the invention moves the field of incremental printing forward by enabling high image quality without degradation of printing throughput.

With the foregoing preliminary observations in mind, this summary now moves on to somewhat more-formal discussion of the invention.

In preferred embodiments of its first major independent facet or aspect, the invention is a method for printing an image. Throughout this document, it is to be understood that an "image" can be essentially any type of image—including but not limited to text, computer-aided design (CAD) drawings, and photograph-like pictures. The method includes executing plural passes of a printhead over a printing medium, each pass forming a swath of marks on the medium.

Also included is—between printing passes of the printhead—stepping the printing medium by a nonzero step distance that varies as between steps. The foregoing may represent a description or definition of the first aspect or facet of the invention in its broadest or most general form. Even as couched in these broad terms, however, it can be seen that this facet of the invention importantly advances the art.

In particular, varying the step distance tends to break up patterns otherwise formed by repetitive coincidences of printing-element (e. g. nozzle) irregularities. Such undesired coincidences can occur consistently only if common step distances are used repetitively.

Repetitive use of step distances has the effect of placing particular irregularly-performing pairs or other groups of printhead elements into conjunction with respect to the printing medium—again and again. The coincidences themselves are always present, at least in a latent or virtual sense, because the pairs or groups of irregularly performing elements are always present in the printhead—but they become visible and thereby objectionable only when developed on the printing medium by regular repetition of step distance.

Although the first major aspect of the invention thus significantly advances the art, nevertheless to optimize enjoyment of its benefits preferably the invention is practiced in conjunction with certain additional features or characteristics. In particular, preferably the step distance varies at substantially every step.

In one satisfactory way of operating, preferred for its simplicity, the step distance substantially alternates between two distinct values. In this situation preferably the number of passes is three; and the two distinct values are one-sixth and one-half of a height of the swath.

Another preference is that the number N of passes be odd, and the step distance varies among values having a form $(2n-1)/2N$, where n is an integer ranging from 1 through N. The point here is that use of the invention to disrupt patterning has a quantitative character.

Alternation, for instance, between two distinct values is better than no variation at all—but not as good as rotation among, say, five distinct values, or seven. Thus patterning is subject to a kind of dilution effect, in which conspicuousness can be suppressed more effectively by forcing the patterning to be progressively more complicated.

Yet another preference is that banding effects produced by said method have substantially twice the spatial frequency of banding effects produced using the same number of passes but with nonvarying step distance. Techniques for obtaining this preferred condition are set forth below. This preference represents a different and more sophisticated kind of quantitative strategy: rather than simply brute-force numerical dilution, this preference invokes what might be called "smart dilution", which specifically aims to produce a kind of patterning to which the human eye is less responsive.

A still further preference is that substantially no two swath edges coincide. Another kind of preference is that the stepping includes using a step distance that is substantially random or randomized.

Some printers in which the invention can be used have an installed algorithm for accommodating print-medium-advance-axis error—as set forth for example in the first Doval document mentioned earlier. If the method invention is practiced in such a printer, then preferably the stepping includes using an adaptation of the error-accommodating algorithm.

In preferred embodiments of its second major independent facet or aspect, the invention is apparatus for printing an image on a printing medium. The apparatus includes a printhead.

It also includes some means for passing the printhead over the medium multiple times. For purposes of generality and breadth in discussing the invention, these means will be called simply the "passing means". Each pass forms a swath of marks on the medium.

The apparatus further includes some means for spacing edges of each swath away from edges of substantially each other swath, so that substantially no two swath edges coincide on such medium. Again for breadth and generality these means will be called the "spacing means".

The term "substantially" is included here twice, to clarify that this second facet of the invention encompasses apparatus having occasional or unimportant departures from the stated conditions. For instance, a competitor may wish to attempt to avoid the sweep of the present invention by refraining from spacing edges of each swath from edges of other swaths.

More specifically, such a strategy might include allowing two swath edges to coincide from time to time. The term "substantially" makes plain that such variations are within the scope of certain of the appended claims, and do not offer an escape from the status of infringer.

The foregoing may represent a description or definition of the second aspect or facet of the invention in its broadest or most general form. Even as couched in these broad terms, however, it can be seen that this facet of the invention importantly advances the art.

In particular, avoiding superposition of different swath edges very greatly reduces the single most conspicuous form or type of banding effect. When one swath edge is closely abutted to another, the abutment is almost always imperfect—leading to a shallow gap between swaths or a shallow overprint where they overlap.

Also the two swaths are generally not exactly the same in darkness or color saturation, adding another element of contrast along the interface. Conspicuousness is therefore reduced simply by spacing of the edges apart along the advance direction.

Although the second major aspect of the invention thus significantly advances the art, nevertheless to optimize enjoyment of its benefits preferably the invention is practiced in conjunction with certain additional features or characteristics. In particular, preferably the spacing means further include some means for modifying a spatial frequency of banding effects produced by the apparatus.

Another preference is that the spacing means include some means for spacing the edges of swaths from each other by a distance that is substantially random or randomized. Still another preference obtains in case the printing apparatus includes an installed algorithm for accommodating print-medium-advance-axis error; in this event the spacing means include means for adapting the error-accommodating algorithm to space the swath edges well away from each other.

From the foregoing it will be clear that the distance by which swath edges are spaced apart can be a lot or a little. Preferably, however, the spacing means space the swath edges well away from each other—namely, at least one-twentieth of the swath dimension in a direction of printing-medium advance.

That is to say, the swath dimension under consideration here is the dimension along the direction of print-medium advance; and it is this dimension that is being compared with the spacing-apart of swath edges. This swath-edge spacing is even more preferably at least one-tenth of the swath dimension.

In preferred embodiments of its third major independent facet or aspect, the invention is apparatus for incrementally printing an image on a printing medium. The apparatus includes a carriage for reciprocation over the medium.

Also included is a printhead on the carriage for forming, in substantially each certain multiple of a half-reciprocation of the carriage, a fully inked swath of marks on the medium. (For example, what is described may be an N-pass printmode, with the "certain multiple" being N for bidirectional printing or 2N for unidirectional printing.)

The phrase "fully inked" does not mean that ink is actually applied to every pixel, since a particular image typically does not call for a inkdrop dot in every pixel. Rather, for the purposes of this form of the invention "fully inked" simply means that all pixels have been inked to the extent that they are supposed to be, for the image involved.

Another way to describe this is to say that the swath has been fully addressed. Based on this discussion it is believed that people skilled in the art will understand what is intended. Each swath has at least one region.

The printhead includes multiple individual printing elements. A number of combinations of groups of the elements are used for printing each region of each swath.

The apparatus also includes some means for increasing the number of combinations used for printing each region. For reasons suggested earlier these means will be called the "number-increasing means".

The foregoing may represent a description or definition of the third aspect or facet of the invention in its broadest or most general form. Even as couched in these broad terms, however, it can be seen that this facet of the invention importantly advances the art.

In particular, increasing the number of combinations strongly dilutes the impact of repetitive coincidences between irregularly printing elements within each combination. This is discussed earlier, in regard to the third preference for the first main aspect of the invention.

Although the third major aspect of the invention thus significantly advances the art, nevertheless to optimize enjoyment of its benefits preferably the invention is practiced in conjunction with certain additional features or characteristics. In particular, preferably the certain multiple of a half-reciprocation is one half-reciprocation; other preferred values are one full reciprocation and two full reciprocations.

Another preference is that the apparatus further include an advance mechanism for providing relative motion between the carriage and the medium, in a direction substantially orthogonal to the reciprocation. With the advance mechanism in this case is at least one processor for automatically stepping the advance mechanism, generally stepping it once for each half-reciprocation.

Furthermore in this case the number-increasing means include some means for operating the stepping means by a step distance that varies as between steps. Yet another preference in this same case is that the stepping-means operating means include at least one part of the at least one processor.

It is also preferred that substantially no two swath edges coincide, and that the step distance vary at substantially every step (preferably at least substantially alternating between two distinct values). Another preference is that banding effects produced by said apparatus have substantially twice the spatial frequency of banding effects produced using the certain multiple of a half-reciprocation but with nonvarying step distance.

A still further preference is that the certain multiple of a half-reciprocation of the carriage over substantially every portion of such medium be three; and if so that the two distinct values be one-sixth and one-half of a height of the swath. A final preference for mention here is that the certain multiple N of a half-reciprocation be odd; and that the step distance vary among values having—as before—the form (2n−1)/2N, with n an integer ranging from 1 through N.

In preferred embodiments of its fourth major independent facet or aspect, the invention is a method for printing an image on a printing medium. The method includes executing plural passes of a printhead over a printing medium.

Each pass forms a swath of marks on the medium. The method also includes—between printing passes of the head—stepping the printing medium by a step distance that is substantially random or randomized.

The foregoing may represent a description or definition of the fourth aspect or facet of the invention in its broadest or most general form. Even as couched in these broad terms, however, it can be seen that this facet of the invention importantly advances the art.

In particular, random influence helps to further disrupt objectionable patterning that arises from repetitive, systematic operation. As previously pointed out, objectionable patterning is subject to quantitative effects, and even sheer numerical dilution is helpful. Such dilution, however, is very greatly enhanced when the plural different step distances occur randomly—or at least in a substantially random, or randomized, way—rather than according to any systematic temporal or spatial pattern.

These objectives, however, are not the only goals encompassed within this fourth facet of the invention under discussion. It is also within the scope of this aspect of the invention to simply wish, for instance, to inject some "noise" into the operation of the system.

There are various reasons for such a strategy. Merely by way of example, the earlier-mentioned patent documents of Garcia have pointed out that a balance between noisiness/graininess and determinism/regularity in an image is one of the general tools of the printing-system designer.

Although the fourth major aspect of the invention thus significantly advances the art, nevertheless to optimize enjoyment of its benefits preferably the invention is practiced in conjunction with certain additional features or characteristics. Generally such preferences are the same as or analogous to those mentioned above for the first three main facets of the invention.

Thus in particular, if the method is practiced in a system that is subject to printing-medium-axis directionality error—and especially if at least some amount of that directionality error is not systematically distributed—then preferably the stepping includes adapting a directionality-error-accommodating algorithm. The algorithm provides the substantially random or randomized step distance, for mitigating whatever amount of the directionality error is not systematically distributed.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

1. The Printer Mechanism

Figure 1:
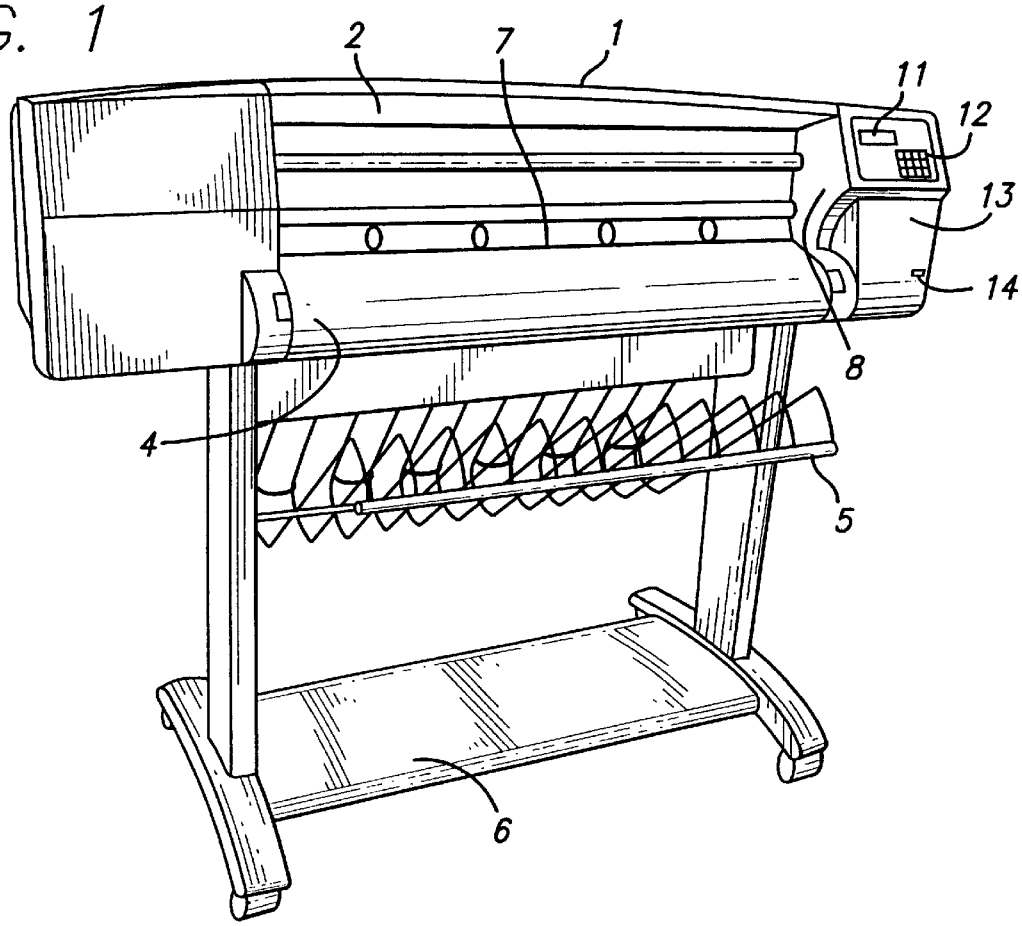
FIG. 1 is a perspective or isometric view of a printer/plotter that is and that incorporates one preferred embodiment of the invention—though the invention is equally applicable with respect to smaller, desktop types of printers in the consumer market.

The invention is amenable to implementation in a great variety of products. It can be embodied in a printer/plotter that includes a main case 1 (FIG. 1) with a window 2, and a left-hand pod 3 which encloses one end of the chassis. Within that enclosure are carriage-support and—drive mechanics and one end of the printing-medium advance mechanism, as well as a pen-refill station with supplemental ink cartridges.

The printer/plotter also includes a printing-medium roll cover 4, and a receiving bin 5 for lengths or sheets of printing medium on which images have been formed, and which have been ejected from the machine. A bottom brace and storage shelf 6 spans the legs which support the two ends of the case 1.

Just above the print-medium cover 4 is an entry slot 7 for receipt of continuous lengths of printing medium 4. Also included are a lever 8 for control of the gripping of the print medium by the machine.

A front-panel display 11 and controls 12 are mounted in the skin of the right-hand pod 13. That pod encloses the right end of the carriage mechanics and of the medium advance mechanism, and also a printhead cleaning station. Near the bottom of the right-hand pod for readiest access is a standby switch 14.

Within the case 1 and pods 3, 13 a cylindrical platen 41 (FIG. 2)—driven by a motor 42, worm 43 and worm gear 44 under control of signals from a digital electronic processor—rotates to drive sheets or lengths of printing medium 4A in a medium-advance direction. Print medium 4A is thereby drawn out of the print-medium roll cover 4.

Meanwhile a pen-holding carriage assembly 20 carries pens back and forth across the printing medium, along a scanning track—perpendicular to the medium-advance direction while the pens eject ink. The medium 4A thus receives inkdrops for formation of a desired image, and is ejected into the print-medium bin 5.

As indicated in the drawing, the image may be a test pattern of numerous color patches or swatches 56, for reading by an optical sensor to generate calibration data. For present purposes, such test patterns are for use in detecting positioning errors.

A small automatic optoelectronic sensor 51 rides with the pens on the carriage and is directed downward to obtain data about pen condition (nozzle firing volume and direction, and interpen alignment). The sensor 51 can readily perform optical measurements 65, 81, 82 (FIG. 11); suitable algorithmic control 82 is well within the skill of the art, and may be guided by the discussions in the present document.

A very finely graduated encoder strip 36 is extended taut along the scanning path of the carriage assembly 20 and read by another, very small automatic optoelectronic sensor 37 to provide position and speed information 37B for the microprocessor. One advantageous location for the encoder strip 36 is immediately behind the pens.

A currently preferred position for the encoder strip 33 (FIG. 3), however, is near the rear of the pen-carriage tray—remote from the space into which a user's hands are inserted for servicing of the pen refill cartridges. For either position, the sensor 37 is disposed with its optical beam passing through orifices or transparent portions of a scale formed in the strip.

The pen-carriage assembly 20 is driven in reciprocation by a motor 31—along dual support and guide rails 32, 34—through the intermediary of a drive belt 35. The motor 31 is under the control of signals from the digital processor.

Naturally the pen-carriage assembly includes a forward bay structure 22 for pens—preferably at least four pens 23–26 holding ink of four different colors respectively. Most typically the inks are yellow in the left-most pen 23, then cyan 24, magenta 25 and black 26.

Another increasingly common system, however, has inks of different colors that are actually different dilutions for one or more common chromatic colors, in the several pens. Thus different dilutions of black may be in the several pens 23—26. As a practical matter, both plural-chromatic-color and plural-black pens may be in a single printer, either in a common carriage or plural carriages.

Also included in the pen-carriage assembly 20 is a rear tray 21 carrying various electronics. The colorimeter carriage too has a rear tray or extension 53 (FIG. 3), with a step 54 to clear the drive cables 35.

Figure 2:
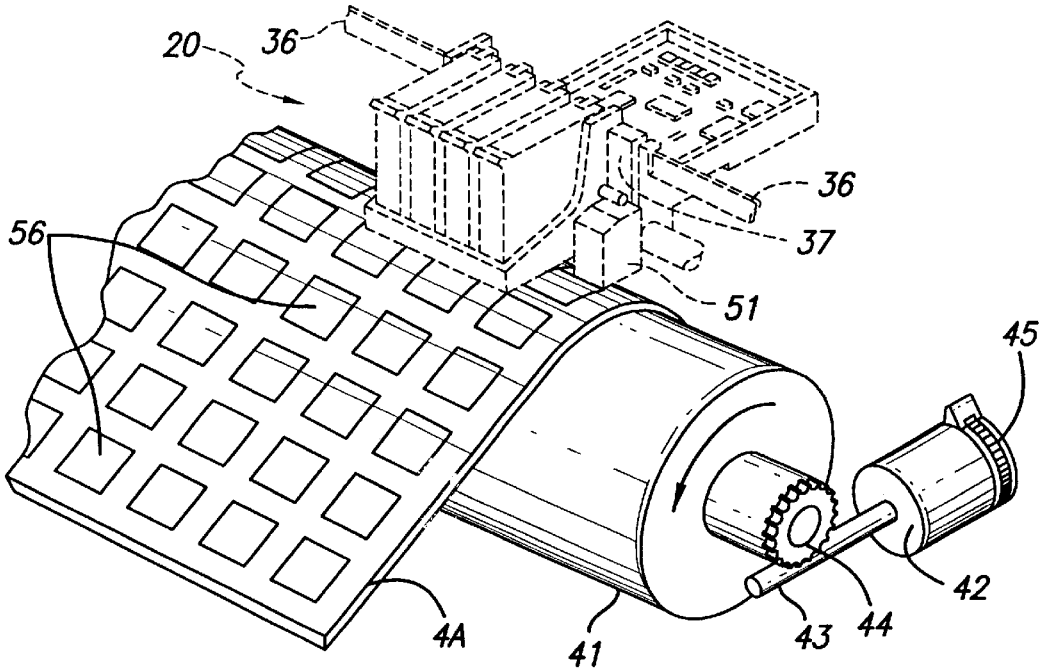
FIG. 2 is a like view, but enlarged, of portions of a printing engine—particularly including the printing-medium advance mechanism—within the FIG. 1 printer plotter.
Figure 3:
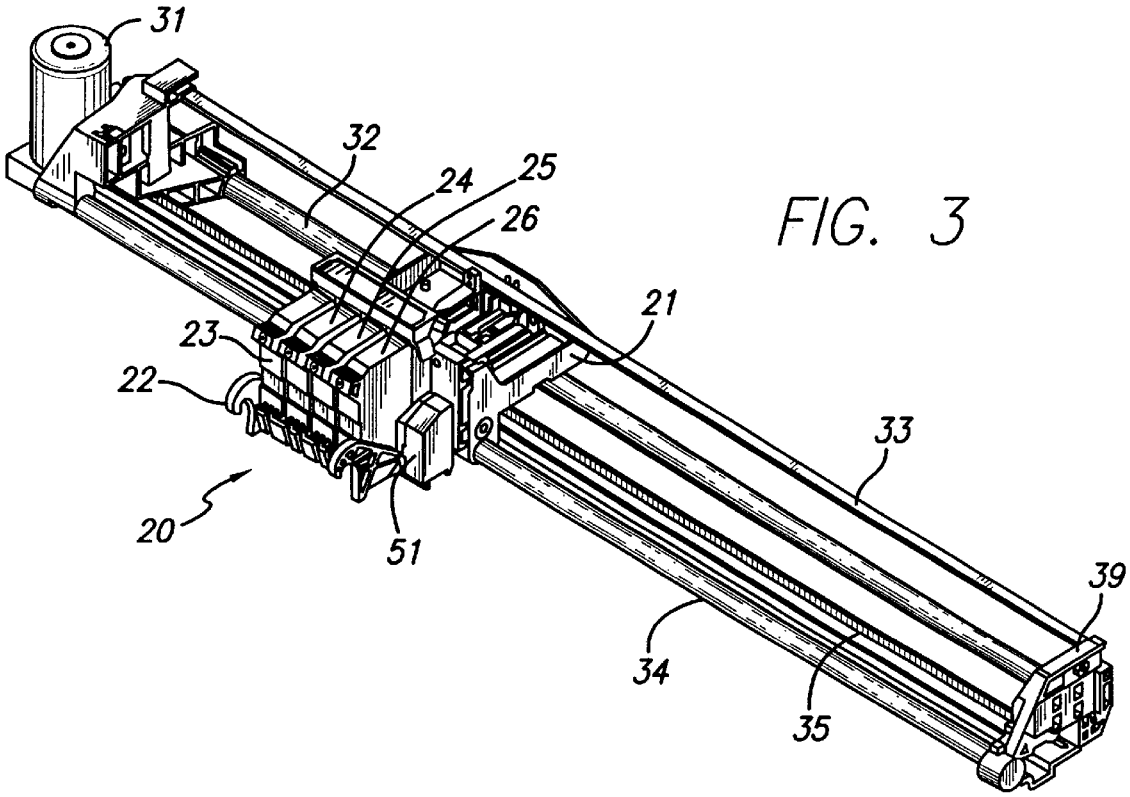
FIG. 3 is a like view, but somewhat less enlarged, of a bigger portion of the print engine.

FIGS. 1 through 3 most specifically represent a system such as the Hewlett Packard printer/plotter model "DesignJet 2000CP", which does not include the present invention. These drawings, however, also illustrate certain embodiments of the invention, and—with certain detailed differences mentioned below—a printer/plotter that includes preferred embodiments of the invention.

2. Raising Spatial Frequency; Offsetting Swath Boundaries

Preferred embodiments of the present invention vary the distance by which the print medium is advanced, in plural-pass printmodes. The advance is best changed frequently—in fact, most often it is changed between each pair of successive passes.

The point is to create a greater number of different locations for the edges of swaths. This strategy requires designing a printmode in such a way that all the pixel positions on the printing medium can be addressed with varying advances.

In addition to varying advances of the printing medium, correspondingly varying advances must be taken in the data to keep the image position on the printing medium in register with that in the data. Based on the descriptions here, skilled programmers in this field will be able to prepare the necessary code to implement the invention.

Following is an example for a three-pass printmode, though the invention can be practiced for any of a great number of different passes. The first operation described will be a three-pass mode that is conventional.

Figure 4:
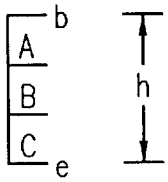
FIG. 4 is a diagram, highly schematic, of the printing-element (e. g. nozzle) array of a representative printhead, as it would be effectively subdivided for a conventional three-pass printmode—and also corresponding to the subdivided structure of a single resulting printed swath on a printing medium, with the heights of the consistent pixel advance and fixed printing-medium advance.

In considering such a mode, it is helpful to think of the dimension h (FIG. 4) of the printed swath in the printing-medium-advance axis (which is roughly the same as the printhead height) as divided into three equal segments A, B and C. The three respective equal heights of these printed swath segments are the printing-medium and data advances.

The beginning b and end e of the swath are formed by the two ends of the overall printhead. As successive passes occur, inking is completed progressively for each swath segment.

For instance segments A, B and C are each partially inked during a first pass (FIG. 5) of the present example. Previous inking in the upper two segments A and B occurs in earlier passes, and the example here picks up with a representative segment C.

Figure 5:
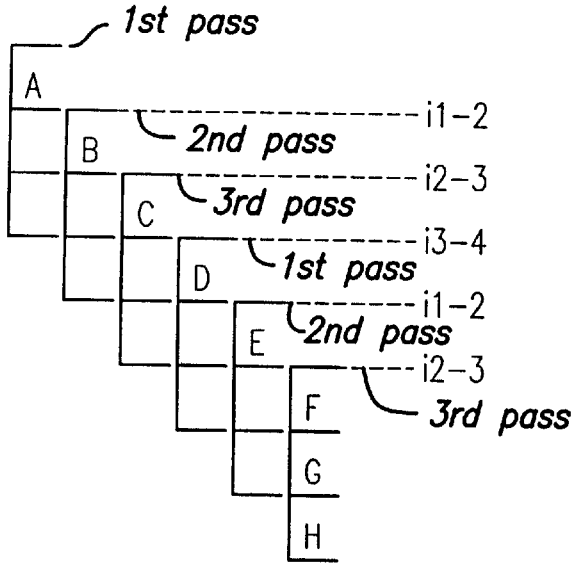
FIG. 5 is an analogous diagram of six printed swaths as formed using the FIG. 4 conventional three-pass mode.

The first pass shown in FIG. 5 is also the first pass in which segment C receives any ink. In a second pass, swath segments B, C and D are each partially inked; and in a third pass, swath segments C, D and E are each partially inked.

In the next "first pass"—i. e. in the first pass of the second cycle shown in FIG. 5—segments D, E and F are each partially inked. Hence segment C receives no ink at all in this pass; in other words, after the third pass, inking of segment C is finished.

Therefore it can be appreciated that segment C is completely inked, from start to finish, in three passes—namely, the first, second and third passes of the first cycle. Each of these passes provides one-third of the total inking for segment C.

Each of the other segments D, E, F, G and H (and A and B as well) similarly is inked in three passes—cycling between the numbered passes in the drawing thus: 123, then 231, 312, and then starting again with 123. Furthermore each pass is inked by the same groups of printing elements (nozzles). Each pass provides one-third of the total colorant placed on the printing medium.

The interfaces (dashed horizontal lines i1-2, i2-3, i3-1) between passes appear at a spatial periodicity of a third of the swath height. The spatial periodicity may also be-expressed in reciprocal terms—that is, in terms of spatial frequency or wavenumber. Thus expressed, the value (measured in "per-swathheight" units) is the reciprocal of the period—namely, three.

At each of these interfaces, the end of one swath coincides with the beginning of another. For instance at interface i3-1 the topmost full swath A-B-C ends and swath D-E-F begins. Banding effects related to swath boundaries accordingly have wavenumber 3 per swathheight (this may be written 3/swathheight, or 3 swathheight$^{-1}$).

Now to compare with this conventional fixed-advance three-pass mode, a variable advance can be sued to double the spatial frequency of the banding. Both the underlying three-pass operation and the doubling of frequency are examples only; other frequency multiples as well as other numbers of passes are possible.

Figure 6:
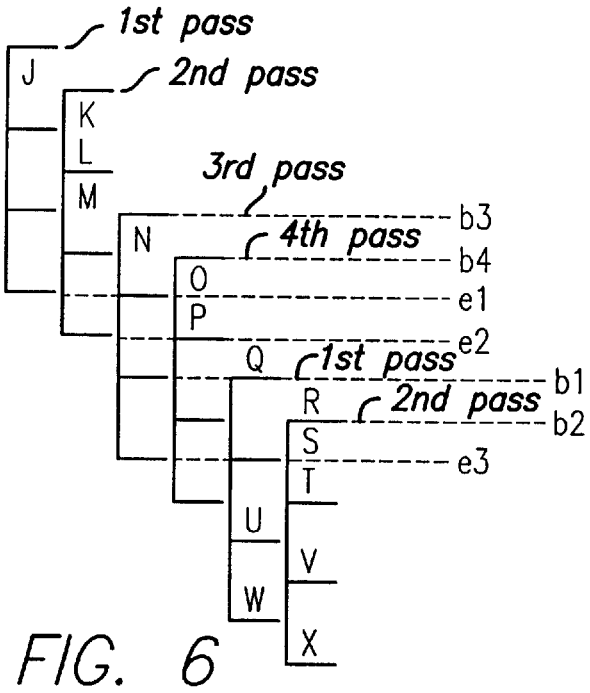
FIG. 6 is a diagram like FIG. 5 but for a three-pass mode according to one preferred embodiment of the present invention, using two systematically selected different advance distances in alternation—the successive passes in this drawing being shown offset slightly from left to right for clarity only, as they are arrayed in a common vertical alignment when actually printed.

Swath segment A will now be identified as two narrower segments J and K (FIG. 6). Remaining segments, too, are subdivided due to the effects of the printhead positions illustrated—yielding segments N through X—or previously printing positions not shown, to produce segments L and M.

To achieve this frequency doubling in a three-pass mode, the advance differs between each successive pair of passes. In the example, the stroke alternates between advancing ⅙ of a swath (as from the first pass to the second) and ⅚=½ of a swath (as from the second to the third).

This way the swath ends e1, e2, e3 and beginnings b3, b4, b1, b2 never coincide. Instead each swath end or beginning always stands alone, so that these features occur at a one-sixth spatial periodicity—or in other words with wavenumber 6/swathheight.

In addition, there are now regions of the swath that are completed by two, or three, or four passes: for example two for segment Q; three for N, P, R and T; four for O and S. In other words, for the illustrated printmode the regions of the image are filled by cycling between passes thus: 12, 123, 1234, 234, 34, 3412, 12, 123 . . . The number of possible combinations of nozzle groupings that print a region of the swath is larger (seven rather than only three).

In this case, to define a pseudo three-pass printmode it is necessary to define an extra, fourth pass; but in reality to print an image, it only takes an extra swath as compared with conventional printmodes. This addition is negligible in terms of throughput impact, and both printmodes take the same time to print.

the scheme described here produces not only doubling of the spatial frequency but also elimination of coincident swath beginning and ends—for a printmode with any odd number of passes. For an even number of passes, the frequency-doubling effect is still obtained but in not the elimination of coincident swath boundaries.

Variation of advance can produce not only doubling but other spatial-frequency multiplications too. Printmasks must be designed with this consideration in mind.

Certain current printmask-generation tools accept only constant advance values as inputs. Therefore they cannot automatically generate the types of masks described here.

Masking for the very simple three-pass frequency-doubling printmode discussed above was accordingly designed manually as a feasibility check. Doubling of banding spatial frequency was in fact obtained, and the improvements as compared with a conventional three-pass mode are very noticeable. Modification of printmask-generation tools was straightforward—and should be so for a programmer skilled in this field—and has been implemented in printmode large-mask generation tools.

The procedures outlined so far offer three advantages, and one possible drawback. First, they can increase spatial frequency of the appearance of banding—thereby reducing its perception.

Second, these procedures enable the offsetting of swath boundaries, so that swath endings and beginnings never coincide—never lie together in a common location. This helps reduce the appearance of coalescence and the media expansion effect at the swath interfaces and intermediate boundaries.

In addition it tends to reduce the effect of PAD error, particularly to the extent that such problems may again come to be concentrated near the ends of the printhead. Also since there is only one swath boundary at each location, rather than two, the sensitivity to errors in print-medium advance stroke is reduced.

A third advantage is to increase the number of combinations of groups of nozzles that print each region of each swath. With conventional, consistent advance, the number of combinations of nozzles that print each region is the same as the number of passes: in a three-pass mode each pixel row is printed with three nozzles—and those same three nozzles print a row in every swath.

Varying the stroke allows more groups of nozzles to print each region, and the periodicity with which lines are printed by common nozzle groupings is greater than a single swath. This is an advantage because the more irregular the nozzle usage, the less susceptible to PAD error is the image quality.

Finally, the potential disadvantage arises from the fact that different regions are completed by different numbers of passes. If some passes are fully inked in n passes, others are inked in n+1 and yet others by n−1; this has been noted above for the expanded three-pass example, in which certain segments are completed in only two of the passes, some require three and others four.

For low numbers of passes, this effect could become a limitation. Since printing media absorb ink at finite rates, some regions are more susceptible to coalescence than others—and in some cases the differing degrees of inking coalescence may be conspicuous.

If perceptible, this effect may introduce a new and undesired form of banding. Such consequences must be carefully explored in designing the associated printmodes.

If necessary this effect can be reduced or avoided. In the case of the three-pass mode detailed above, as an example, for the regions that are printed in four passes the printmode can be designed to complete the inking in three passes, or in three and a half.

This can be accomplished by reducing or eliminating the amount of ink actually applied in the fourth pass. In this way the variation of coalescence about a typical or average value is held to an acceptable level.

3. Stronger Variation of Printing-Element Combinations

The embodiments of the invention described in the preceding section aim primarily to make banding much less conspicuous, with some added disruption of the banding itself. Those of this present section aim to disrupt the banding completely, though still without eliminating any printhead PAD defects that contribute to the banding.

Bands are more visible if a defective nozzle or other printing element is paired with another defective nozzle than if paired with a nondefective nozzle. Analogously for groups of three or more nozzles: bands are more visible if two defective nozzles are grouped together with a nondefective nozzle than if they are separated into two groups, each with plural nondefective nozzles. Bands are also more visible if three or more defective nozzles are grouped together than if they are separated.

Preferred embodiments of the invention break up patterns by refraining from always pairing the same two nozzles together to form a dot row. When a poorly performing nozzle is paired with a well-performing nozzle (or region of such nozzles), the banding is inconspicuous, and may be hard to see even if an observer is looking for it.

Varying the pairing of nozzles breaks up the repeating (e. g. 6 mm or quarter-inch) pattern. As already noted, this approach does not reduce the overall number of defects—but by breaking up repeated patterns it does make the defects much less noticeable.

Figure 7:
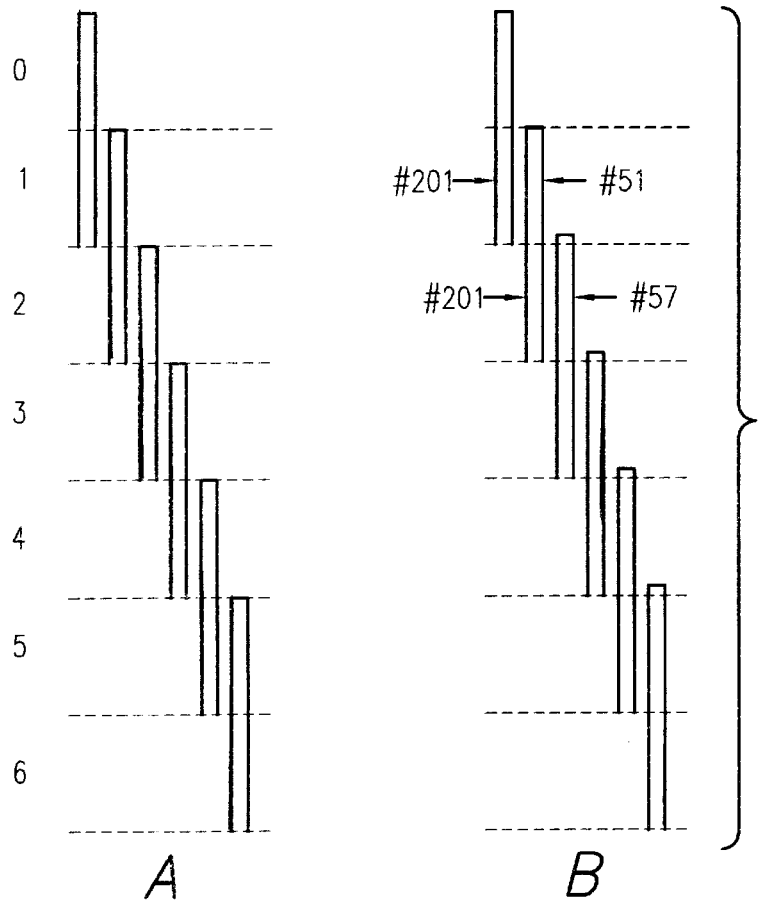
FIG. 7 is a diagram generally like the contrasting views of FIGS. 5 and 6, respectively (though using a slightly different graphical convention), but showing in the "A" view at left six passes in a three-pass printmode with traditional uniform advance, and in the "B" view at right with nonuniform advance in accordance with a second preferred embodiment of the present invention, using several different slightly discrepant advance distances in rotating or other succession.
Figure 8:
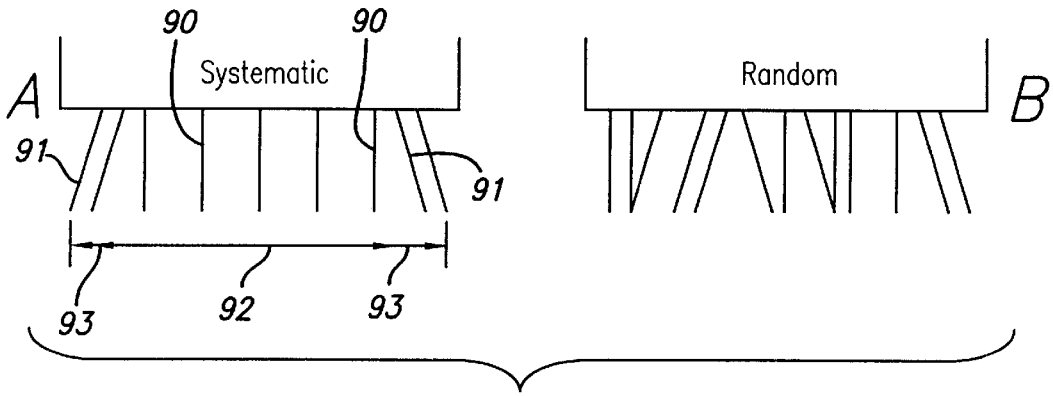
FIG. 8 is an elevational diagrammatic showing of a nozzle array with systematic out-board-aiming PAD error in the "A" view and with currently more representative random PAD error in the "B" view.

In a two-pass printmode with a 300-nozzle pen, for example, a conventional uniform-advance printmode (FIG. 7, left-hand "A" view) is subject to conspicuous banding for the reasons outlined above. The consistent pairing appears in the left-hand four columns of the accompanying Table.

Varying the advance from 141 through 150 pixel rows makes available ten different nozzle pairings rather than only a single pairing for the uniform-advance mode. These varied pairings appear in the right-hand three columns (considered together with the pass number in the leftmost column) of the Table.

For example as between the first and second passes, with a full 150-row advance, nozzle number 201 (FIG. 7, right-hand "B" view) is paired with nozzle 51—corresponding to the first row of the Table, as there listed for pass 1. Then as between the second and third passes, with an advance of only 144 rows, the same reference nozzle 201 is instead paired with nozzle 57—corresponding to the second row of the Table, as listed for pass 2.

Note that the nonuniform advance values, tabulated against pass number, follow no simple monotonic or other straightforward arithmetic progression. Accordingly an irregular pattern is followed by the starting nozzles (penultimate column) and paired nozzles (rightmost column) as well.

This irregularity aims to provide significant though not necessarily maximum difference between the actual and nominal advances—and also between the actual advances used in succession. As passes 7 through 9 demonstrate, in general this goal cannot be attained consistently. One particularly satisfactory implementation is adjustment of the advance by multiples of two nozzle rows. Where a conventional advance is 96 nozzles for example, this strategy randomizes among 92, 94, 96, 98, and 100.

This approach also has been successfully tested on a testbed using advances of 132, 140 and 148 pixel rows. Preferred embodiments of this form of the invention are not limited to two-pass printmodes, but rather are applicable as well to printmodes using more passes.

4. Random Variation

The embodiments of the invention described in the preceding two sections aim primarily make banding less conspicuous, or to disrupt the banding itself, or both, but to do so in systematic ways. Those of this present section extend the strategies to encompass nonsystematic techniques—still without eliminating any of the printing-element defects that produce the banding.

Randomly varying the advance stroke helps to hide PAD errors by keeping them from repetitively falling in the same relative positions along the composite printed image. Following is an idea of how this works, in the same context previously discussed with reference to FIG. 9.

With a nominal advance, when areas with PAD errors (lighter gray, FIG. 10 left-hand "A" view) fall aligned in certain pass combinations, they must fall always thus aligned. That is, they are aligned every time the same combinations of passes and swaths 94–96 occur—producing areas in the composite printout 98 that are consistently lighter.

Figure 9:
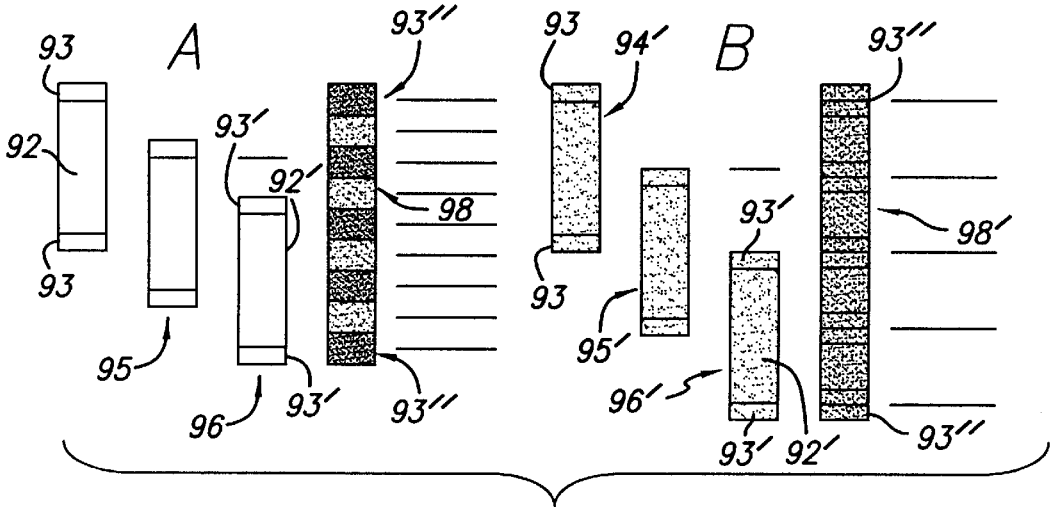
FIG. 9 is a pair of plan views of printed swaths as spaced, and with patterning, resulting from the FIG. 8A systematic out-board-aiming PAD error—assuming in the "A" view use of the nominal advance stroke, and in the "B" view operation of a PAD-error-accommodating system.
Figure 10:
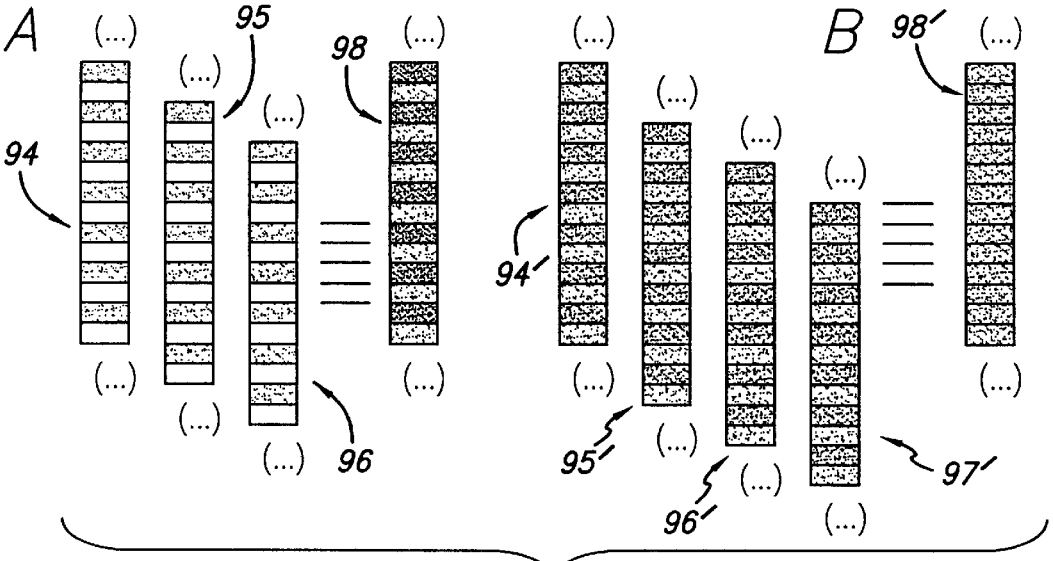
FIG. 10 is an analogous pair of plan views showing swaths as printed with the FIG. 8B random PAD error and, in the "A" view, with nominal stroke; but in the "B" view with randomly varying stroke according to yet a third preferred embodiment of the invention.

(The illustration here is not prepared using the same assumptions and notation as FIG. 9, which as will be recalled addressed end effects. Here a much higher overall number of passes is tacitly assumed, simply for purposes of illustration, so that the successive swaths shown are longitudinally offset by only a small fraction of the swath dimension. The illustrated swaths 94–96 in FIG. 10A and 94'–97' in FIG. 10B are also representative, rather than a complete set for the length of the composite 98 or 98'. FIG. 10 may be seen accordingly as more schematic than FIG. 9.)

With randomized advanced (right-hand "B" view), areas with PAD errors are instead sometimes paired or combined with areas that are free of PAD errors—and sometimes not, even when the same combinations of passes and swaths 94'–97' recur. The reason is that the recurrence of pass combinations is not accompanied by recurring alignments as before; these are disrupted by the random variations of advance stroke.

As noted earlier, some inkjet printers already have an installed algorithm for providing a multiplier to the nominal or theoretical print-medium advance, to accommodate date the earlier, systematic PAD-error swath extensions. This multiplier, again, is called the PAD factor.

In a typical application, the printer calculates the optimal PAD factor for each head, $PF_1$, $PF_2$, . . . It then averages the PAD factors, weighting them by their respective usages $U_1$, $U_2$, . . . in the next (or preceding) pass:

$$PF=(PF_1 \cdot U_1+PF_2 \cdot U_2+\ldots)/(U_1+U_2+\ldots) \quad [1$$

The printer then applies the resultant weighted-mean PAD factor—which is very close to unity—to the nominal paper advance required for the next pass:

$$\text{FINAL ADVANCE}=\text{NOMINAL} \cdot PF \quad [2$$

A new algorithm according to preferred embodiments of the present invention can work in either of two ways:

take advantage of the actual algorithms to randomize around the optimal value, or simply randomize.

The first way simply takes the result of equation "[1" and uses it as a mean $\mu$, to extract a random number around it. If a normal distribution $N(\mu,\sigma)$ is desired, all that is required is to define a value of the standard deviation $\sigma$. Then $$PF_R=X, \quad [3$$

where X≡a random number coming from the distribution N(PF,σ). Equation "[2" then becomes $$\text{FINAL ADVANCE}=\text{NOMINAL}\cdot PF_R. \quad [4$$

Even if PF remains precisely constant (which is unlikely), $PF_R$ varies around it, depending on σ.

The second way is a simplification of the first, simply setting the mean $\mu\equiv 1$. Again, for a normal-distribution example a standard deviation must be defined, and the randomized pad factor is then $$PF_R=X, \quad [5$$

with X now≡a random number coming from the distribution N(1.0,σ).

The preferred embodiment described above has been tested in a representative printer of the Hewlett Packard model "DesignJet 105x" series. This large-format inkjet printer already incorporates the PAD-factor algorithm explained above, so that prototyping of the invention was very easy. Normal distribution was used, and the steps were:

1. Define σ.
2. Calculate PF as above (the printer does it).
3. Get two random numbers $x_1$ and $x_2$ from a uniform distribution (usual in any modern programming language).
4. Calculate $y=(-2\ln(x_1))^{1/2}\cdot\cos(2\pi x_2)$, a random number distributed N(0,1).
5. Generalize it to another average and standard deviation: $PF_R=PF+y\cdot\sigma$—or, if the second above-described approach is preferred, i. e. randomizing about the nominal advance, instead substitute PF=1.
6. Apply the previously presented equation "[4":

$$\text{FINAL ADVANCE}=\text{NOMINAL}]PF_R. \quad [4$$

The results of this procedure are closely analogous to the multiple-nozzle-combination approach set forth in the preceding section 4, but in general may provide slightly improved image quality.

The systematic variation of advance distance described in that text, and shown in the accompanying Table, is simply replaced by a random or randomized variation. The effect is to further disrupt patterning due to undesired repetitions of nozzle-combination coincidences.

5. Hardware and Program Implementations of the Invention

Figure 11:
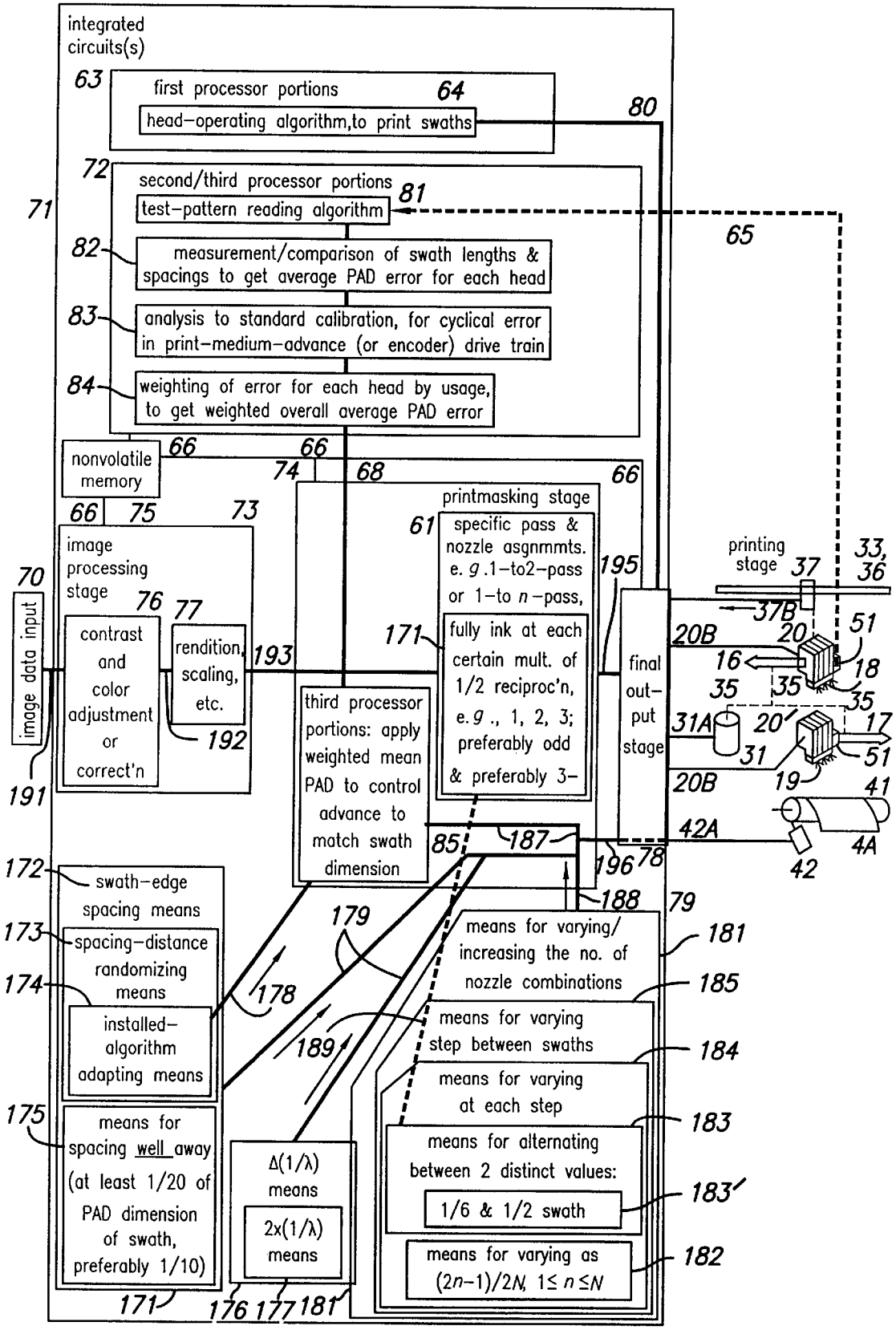
FIG. 11 is a schematic block diagram, focusing upon the functional blocks within the program-performing circuits of the preferred embodiment.

Before discussion of details in the block diagrammatic showing of FIG. 11, a general orientation to that drawing will be offered first. In FIG. 11, most portions 70, 73,75–78 across the center, including the printing stage 4A-51 at far right, are generally conventional and represent the context of the invention in an inkjet printer/-plotter.

The top portion 63–72, 81–85 and certain parts 85, 61 of the central portions of the drawing represent most of the previously mentioned Doval invention relating to PAD-error accommodation. That material is essentially copied here because it too forms a part (though an optional part) of the environment of the present invention.

The reason is that the PAD-accommodating system—already installed in certain inkjet printers, especially large-format machines—can be adapted to perform certain of the functions of the present invention. These parts of the drawing are discussed in detail in the Doval document and are believed to be self explanatory, and hence will not be discussed in detail here.

The remaining central portions 170 and lower portions 171–188 of FIG. 11 relate to the present invention particularly. In this lower section the three main blocks 171, 176, 181 are drawn overlapping to symbolize the conceptually overlapped character of functions in these blocks: the swath-edge spacing means 171, wavenumber (1/λ) varying means 176 and nozzle-combination varying or increasing means 181 are most preferably integrated with one another, so that the corresponding main aspects of the invention are practiced in combination together.

Now turning to details, the pen-carriage assembly is represented separately at 20 (FIG. 11) when traveling to the left 16 while discharging ink 18, and at 20' when traveling to the right 17 while discharging ink 19. It will be understood that both 20 and 20' represent the same pen carriage.

The previously mentioned digital processor 71 provides control signals 20B to fire the pens with correct timing, coordinated with platen drive control signals 42A to the platen motor 42, and carriage drive control signals 31A to the carriage drive motor 31. The processor 71 develops these carriage drive signals 31A based partly upon information about the carriage speed and position derived from the encoder signals 37B provided by the encoder 37.

(In the block diagram all illustrated signals are flowing from left to right except the information 37B fed back from the sensor—as indicated by the associated leftward arrow.) The codestrip 33 thus enables formation of color inkdrops at ultrahigh precision during scanning of the carriage assembly 20 in each direction—i. e., either left to right (forward 20') or right to left (back 20).

New image data 70 are received 191 into an image-processing stage 73, which may conventionally include a contrast and color adjustment or correction module 76 and a rendition, scaling etc. module 77.

Information 193 passing from the image-processing modules next enters a printmasking module 74. This may include a stage 61 for specific pass and nozzle assignments. The latter stage 61 performs generally conventional functions, but in accordance with certain aspects of the present invention is preferably constrained to printmodes that use very small numbers of passes—for example one-pass or two-pass modes.

Nevertheless, the invention is also amenable to use with greater numbers of passes as suggested by the notation "or 1- to n-pass" in block 61. Also within that block is an additional constraint 170 to printing a fully inked swath at each certain multiple of a half reciprocation of the carriage 20, 20'—not necessarily a preference but rather simply a condition to which are linked 189 certain preferred embodiments of the invention discussed below.

The term "half reciprocation" means a single, unidirectional pass of the printhead carriage—as for example only from left to right, or only from right to left. Noted values of the "certain multiple" include one, two and three; however, odd values are most highly preferred for swath-edge separation and for wavenumber raising, and for these purposes three may be ideal.

A different choice may be more favorable for forms of the invention that use rotation or random variation among a relatively large number of step-distance values. In these cases, a "certain multiple" of one or two may be ideal since these provide the highest possible throughput.

With these thoughts in mind as to constraints on the pass and nozzle assignments function 61, the discussion now turns to features more particular to the present invention. Certain features 172 are particularly well-suited to control 178 or "adaptation" of the preinstalled PAD-error-accommodating algorithm 72, 81–85.

These features include the swath-edge spacing means 172 discussed in section 2 above. Associated with these means are the spacing-distance randomizing means 173, which is most particularly associated with the algorithm-adapting means 174 and its link to the algorithm block 85.

The latter block 85 is connected 187, 196 to control the final output stage 78, particularly in regard to its generation of the print-medium advance signals 42A. All of the other features 175–188, however, can also be implemented in this same way—even though they are not so illustrated.

If it is preferred not to employ the PAD-error-accommodating system 72, 81–85 to effectuate the control by the spacing means 172, then instead an alternative arrangement can be employed. One alternative path 178 introduces the needed information into the output-stage control bus 196 downstream of the PAD algorithm block 85, as shown. The other print-medium advance strategies of the invention, if not routed through the algorithm block 85 as mentioned in the preceding paragraph, likewise can be implemented 179, 188 more directly.

A preferred form of the edge spacing means 172 includes means 175 for spacing of the edges distinctly well away from one another. Preferred values of such spacing include at least a twentieth of the PAD dimension of the swath—i. e. the dimension of the swath in the printing-medium advance direction. Spacing the edges apart by a tenth of the swath PAD dimension is still more preferable in practice, as it corresponds to a printmode using a smaller number of passes.

Preferred embodiments of the invention also include means 176 for raising the spatial frequency or "wavenumber" of the banding in printed images. As the drawing is crowded, the accepted wavenumber notation "$1/\lambda$" has been used to represent spatial frequency, "$\Delta$" to represent variation, and "$2\times$" to represent doubling. Accordingly the spatial-frequency varying means 176 appear labeled as $\Delta(1/\lambda)$ and the preferred spatial-frequency doubling means 177 as $2\times(1\lambda)$.

The remaining means 181 are for varying the number of nozzle combinations used to print an image. Generally speaking such variation preferably takes the form of an increase.

Preferably in turn these means 181 include means 185 for varying the length of the step or stroke between the swaths. These latter means 185 in turn include means 184 for providing such variation at each step.

In one preferable form of these stepwise varying means 184, they include means 183 for alternating between two distinct values. As the drawing is meant to suggest, these means 183 are linked 189 at least conceptually to the use of a three-pass mode, which as shown by the example earlier is one preferred way of operating the pass/assignment block 61.

Still with reference to that same operation, the alternating means 183 are particularly well implemented 183' with one-sixth and one-half swath PAD dimension steps. Another preferred form of the stepwise varying means 184 takes the form of means for varying in accordance with the function $(2n-1)/2N$ as previously mentioned, with n ranging from 1 through N, and the value N (the number of passes) preferably odd as the drawing is intended to connote.

The means represented by the several blocks 171, 176, 181 as shown are implemented within integrated circuits 71. Given the statements of function and the swath diagrams presented in this document, an experienced programmer of ordinary skill in this field can prepare suitable programs for operation of the circuits.

As is well known, the integrated circuits 71 may be part of the printer itself, as for example an application-specific integrated circuit (ASIC), or may be program data in a read-only memory (ROM)—or during operation may be parts of a programmed configuration of operating modules in the central processing unit (CPU) of a general-purpose computer that reads instructions from a hard drive.

Most commonly the circuits are shared among two or more of these kinds of devices. Most modernly, yet another alternative is a separate stand-alone product, such as for example a so-called "raster image processor" (RIP), used to avoid overcommitting either the computer or the printer.

Figure 12:
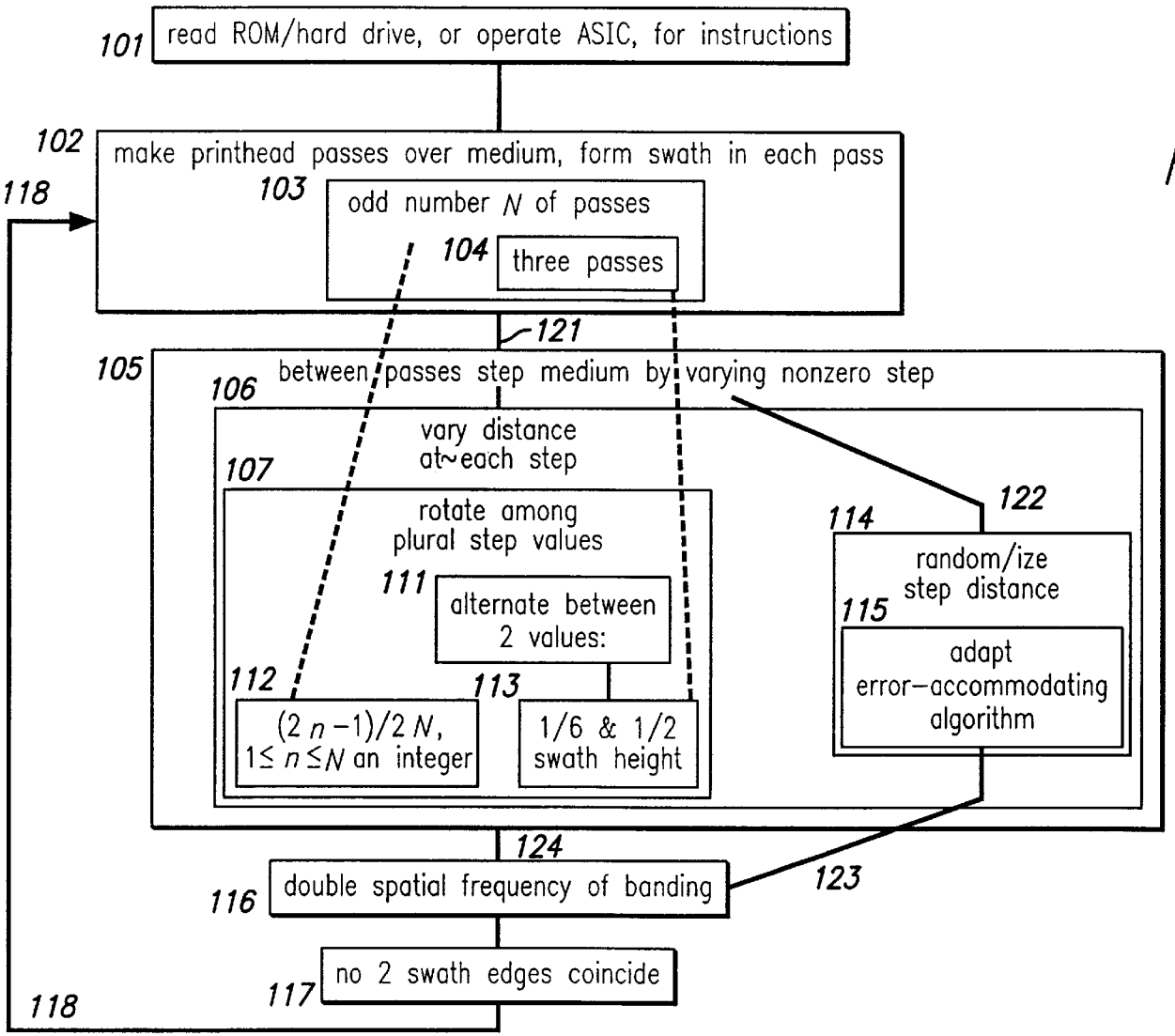
FIG. 12 is a program flow chart illustrating operation of preferred embodiments for some method aspects of the invention.

In operation the system retrieves 101 (FIG. 12) its operating program appropriately—i. e., by reading instructions from memory in case of a firmware or software implementation, or by simply operating dedicated hardware in case of an ASIC or like implementation. Once prepared in this way, the method proceeds to iterate 118 the operational steps 102–117, 122–124. In view of the foregoing it is believed that the person skilled in this field will find the details of FIG. 12 self explanatory.

The above disclosure is intended as merely exemplary, and not to limit the scope of the invention—which is to be determined by reference to the appended claims.

What is claimed is:

1. A method for printing an image; said method comprising:

executing plural passes of a printhead over a printing medium, each pass forming a swath of marks on the medium; and between printing passes of the printhead, stepping the printing medium by a nonzero step distance that varies by at least ten pixels as between steps, but is always in a forward direction and less than three-quarters of a swath height; and wherein:

pen masking is not used, except for masking necessary for swath alignment.

2. The method of claim 1, wherein:

the step distance substantially alternates between two distinct values.

3. The method of claim 1, wherein:

substantially no two swath edges coincide within one-twentieth of the height of the shallowest swath.

4. The method of claim 1, wherein:

the step distance varies at substantially every step.

5. The method of claim 1, wherein:

the step distance substantially rotates among plural distinct values.

6. The method of claim 5, wherein:

the step distance substantially rotates among said plural distinct values in a predetermined sequence of said values.

7. Apparatus for printing an image on a printing medium; said apparatus comprising:

a printhead;

means for passing the printhead over such medium multiple times, each pass forming a swath of marks on such medium; and means for spacing edges of each swath away from edges of substantially each other swath by at least ten pixels, but always less than three-quarters of a swath height so that substantially no two swath edges coincide on such medium; and wherein:

pen masking is not used, except for masking necessary for swath alignment.

8. The apparatus of claim 7, wherein:

the spacing means further comprise means for modifying a spatial frequency of banding effects produced by the apparatus.

9. The apparatus of claim 7, wherein:

the spacing means comprise means for spacing the edges of swaths from each other by a distance that is substantially random or randomized.

10. The apparatus of claim 7:

further comprising an installed algorithm for accommodating print-medium-advance-axis error; and wherein:

the spacing means comprise means for adapting the error-accommodating algorithm to space the swath edges away from each other.

11. The apparatus of claim 7, wherein:

the spacing means comprise means for spacing the swath edges well away from each other, namely at least one-twentieth of the swath dimension in a direction of printing-medium advance.

* * * * *